US009107506B2

(12) United States Patent
McNae

(10) Patent No.: US 9,107,506 B2
(45) Date of Patent: Aug. 18, 2015

(54) CONVERTIBLE FURNITURE

(71) Applicant: Robert McNae, Wayzata, MN (US)

(72) Inventor: Robert McNae, Wayzata, MN (US)

( * ) Notice: Subject to any disclaimer, the term of this patent is extended or adjusted under 35 U.S.C. 154(b) by 0 days.

(21) Appl. No.: 14/269,558

(22) Filed: May 5, 2014

(65) Prior Publication Data

US 2015/0028632 A1 Jan. 29, 2015

Related U.S. Application Data

(60) Provisional application No. 61/824,632, filed on May 17, 2013.

(51) Int. Cl.

| | |
|---|---|
| ***A47C 7/02*** | (2006.01) |
| ***A47C 3/16*** | (2006.01) |
| ***A47C 16/02*** | (2006.01) |
| *A47C 27/08* | (2006.01) |

(52) U.S. Cl.
CPC . *A47C 3/16* (2013.01); *A47C 16/02* (2013.01); *A47C 27/086* (2013.01)

(58) Field of Classification Search
CPC ..... A47C 16/02; A47C 3/16; A47C 27/086
USPC ..... 297/130, 118, 452.41, DIG. 3, 284.6, 297/228.12, 129, 228.13, 391, 452.17, 297/284.1; 5/710, 124, 655.3, 712; 190/8
See application file for complete search history.

(56) References Cited

U.S. PATENT DOCUMENTS

| | | | | |
|---|---|---|---|---|
| 3,763,972 | A * | 10/1973 | Karzmar | 190/8 |
| 4,190,918 | A * | 3/1980 | Harvell | 5/653 |
| 5,816,463 | A * | 10/1998 | Echeverri | 224/584 |
| 6,045,178 | A * | 4/2000 | Miller | 297/129 |
| 6,206,463 | B1 * | 3/2001 | Whigham | 297/129 |
| 6,244,481 | B1 * | 6/2001 | Brougher | 224/153 |
| 6,588,840 | B1 * | 7/2003 | Lombardo | 297/228.12 |
| 6,848,746 | B2 * | 2/2005 | Gentry | 297/380 |
| 6,952,906 | B2 * | 10/2005 | Nelson | 53/434 |
| 7,438,356 | B2 * | 10/2008 | Howman et al. | 297/180.11 |
| 7,823,969 | B2 * | 11/2010 | Kelleher | 297/188.12 |
| 8,336,964 | B2 * | 12/2012 | Cho | 297/452.17 |
| 8,585,151 | B2 * | 11/2013 | Goldman et al. | 297/452.17 |

* cited by examiner

*Primary Examiner* — Chi Q Nguyen
(74) *Attorney, Agent, or Firm* — Dicke, Billig & Czaja, PLLC

(57) ABSTRACT

Convertible furniture including an outer enclosure and a fill material. The outer enclosure defines an enclosed region. The outer enclosure includes at least one closure mechanism that is positionable in an open configuration and a closed configuration. When the at least one closure mechanism is in the closed configuration, the enclosed region has a first volume. When the at least one closure mechanism is in the open configuration, the enclosed region has a second volume that is larger than the first volume. The fill material is placed in the enclosed region.

12 Claims, 3 Drawing Sheets

CONVERTIBLE FURNITURE

REFERENCE TO RELATED APPLICATION

This application claims priority to U.S. Provisional Application No. 61/824,632, which was filed on May 17, 2013, the contents of each of which are incorporated herein by reference.

FIELD OF THE INVENTION

The invention generally relates to furniture. More particularly, the invention relates to bean bag furniture that is convertible between a chair and an ottoman.

BACKGROUND OF THE INVENTION

Bean bag furniture typically includes an outer enclosure in which a mass of foam beads are placed. One type of foam beads that are typically used in bean bag furniture is expanded foam because the expanded foam has a relatively low density, which means that bean bag furniture has a relatively low weight.

Bean bag furniture is popular because it may be used to support at least one person in a variety of configurations. The bean bag furniture may be moved to the different configurations to manually urge the foam beads into a desired shape.

SUMMARY OF THE INVENTION

An embodiment of the invention is directed to convertible furniture that includes an outer enclosure and fill material. The outer enclosure defines an enclosed region. The outer enclosure includes a closure mechanism that is positionable in an open configuration and a closed configuration. When the at least one closure mechanism is in the closed configuration, the enclosed region has a first volume. When the at least one closure mechanism is in the open configuration, the enclosed region has a second volume that is larger than the first volume. The fill material is placed in the enclosed region.

Another embodiment of the invention is directed to convertible furniture that includes an outer enclosure and fill material. The outer enclosure defines an enclosed region. The outer enclosure includes a closure mechanism that is positionable in an open configuration and a closed configuration. When the at least one closure mechanism is in the closed configuration, the enclosed region is positionable in a first shape. When the at least one closure mechanism is in the open configuration, the enclosed region is positionable in a second shape that is different than the first shape. The fill material is placed in the enclosed region.

Another embodiment of the invention is directed to a method of using convertible furniture. Fill material is placed in an enclosed region of an outer enclosure. The outer enclosure includes a closure mechanism. The at least one closure mechanism is positioned in a closed configuration. When the at least one closure mechanism is in the closed configuration, the outer enclosure has a first volume. The at least one closure mechanism is placed in an open configuration. When the at least one closure mechanism is in the open configuration, the outer enclosure has a second volume that is larger than the first volume.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE INVENTION

Figure 1:
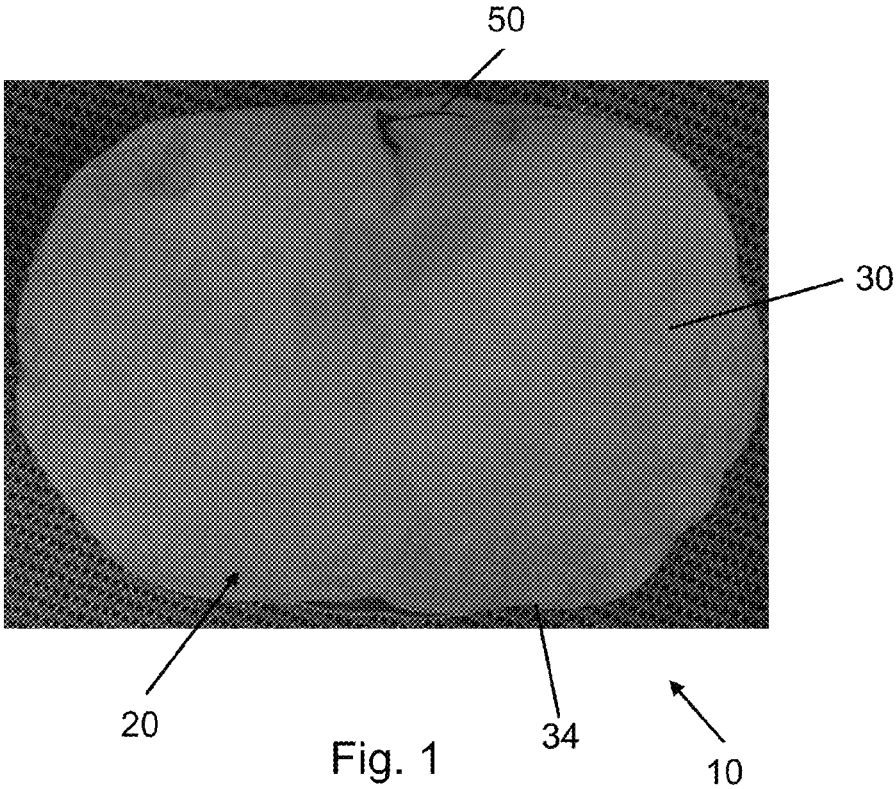
FIG. 1 is a top view of convertible bean bag furniture according to an embodiment of the invention where the convertible bean bag furniture is in a first configuration.
Figure 2:
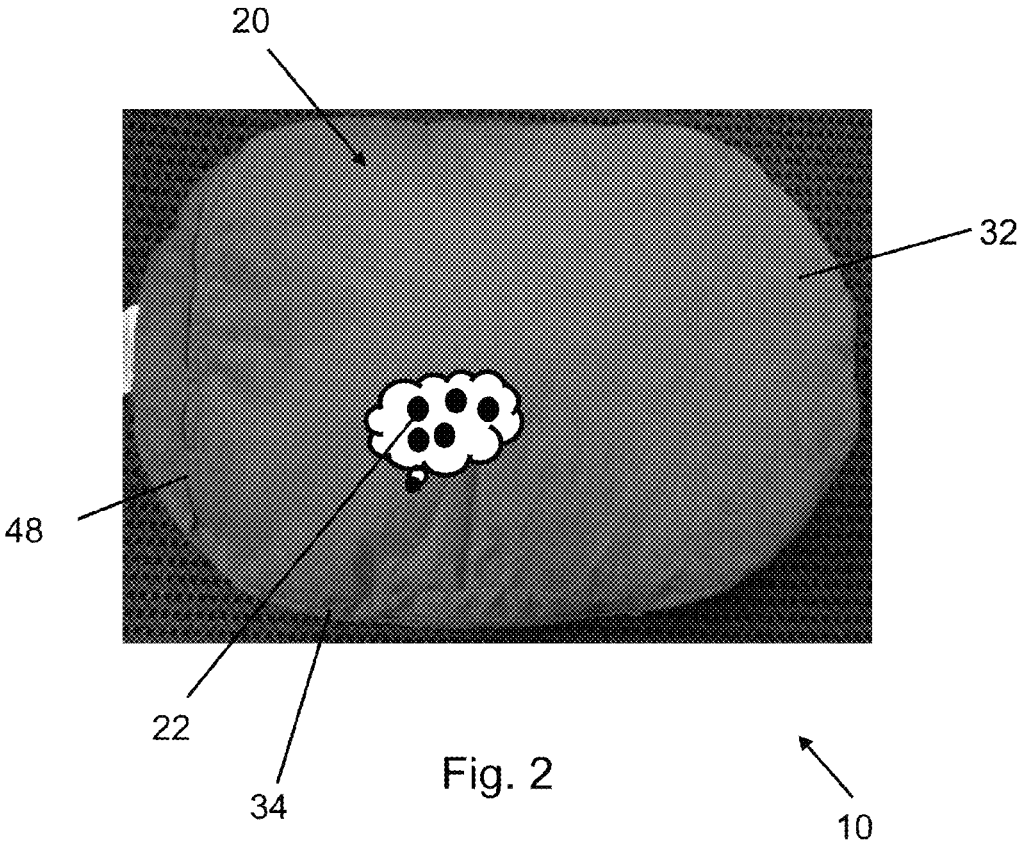
FIG. 2 is a bottom view of the convertible bean bag furniture in the first configuration.
Figure 3:
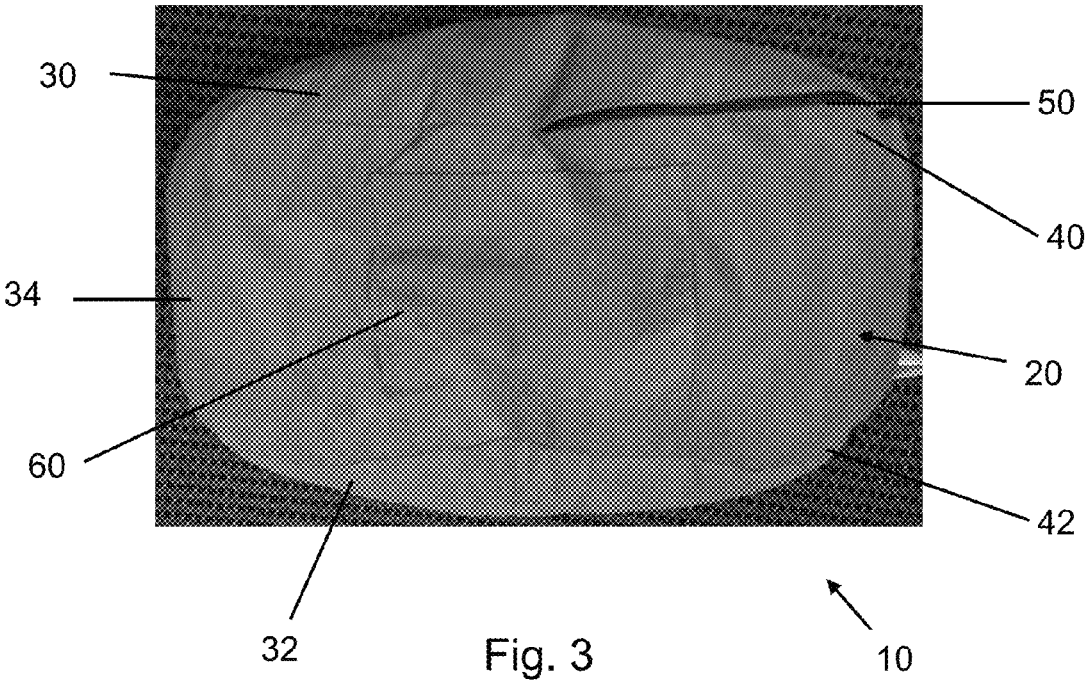
FIG. 3 is a side view of the convertible bean bag furniture in the first configuration.
Figure 4:
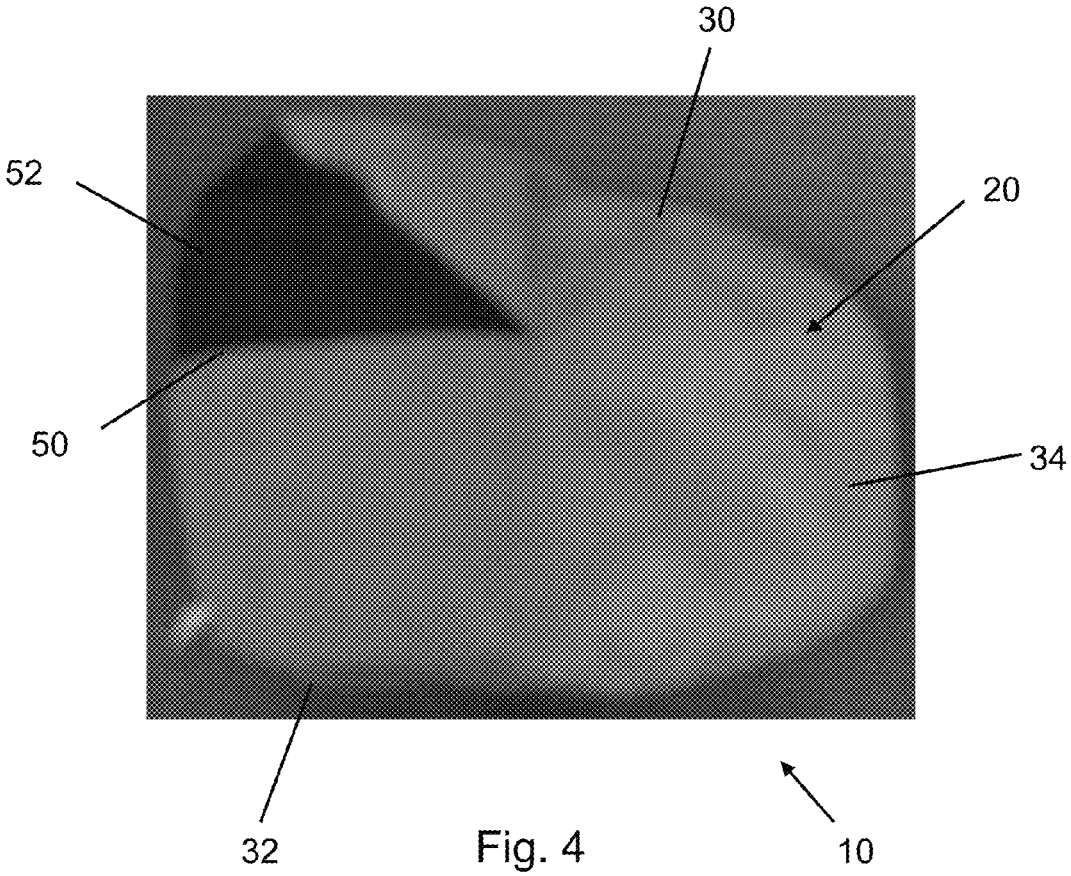
FIG. 4 is a side view of the convertible bean bag furniture in a second configuration.
Figure 5:
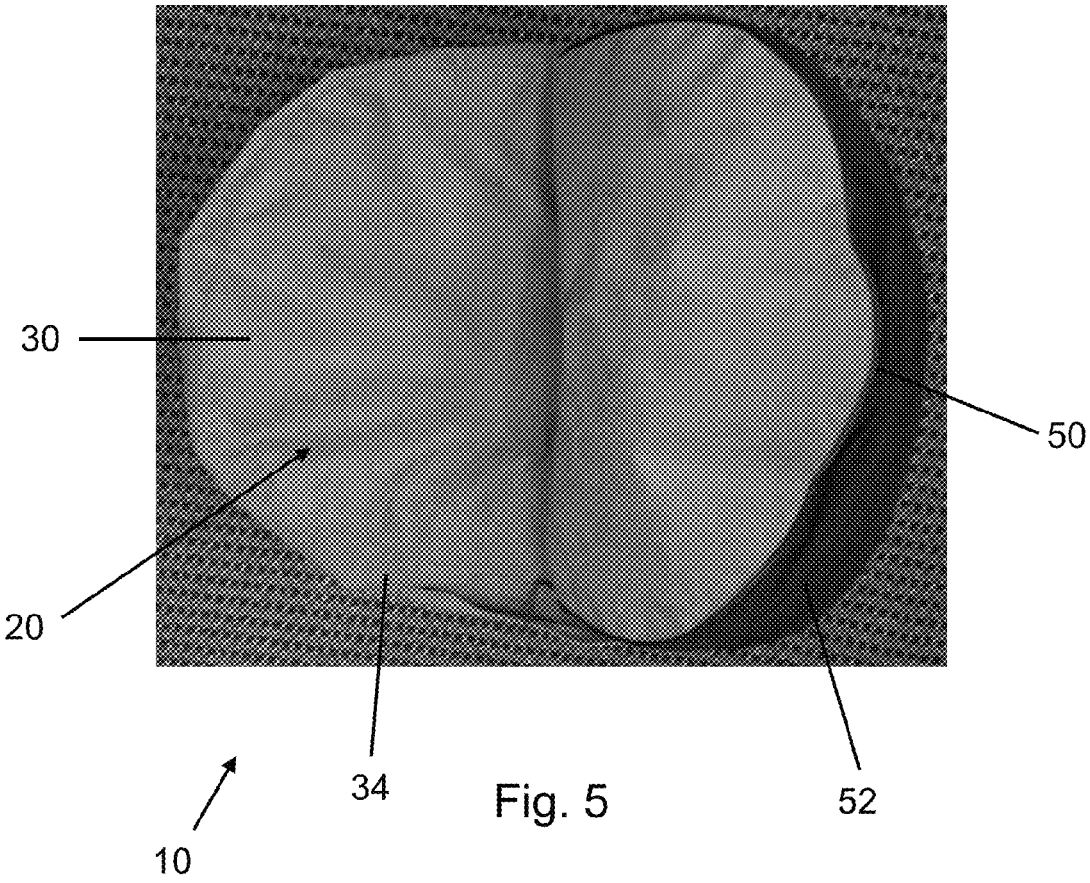
FIG. 5 is a top view of the convertible bean bag furniture in the second configuration.

An embodiment of the invention is directed to convertible bean bag furniture as illustrated at 10 in the associated drawings. An example of two configurations in which the convertible bean bag furniture 10 may be used is an ottoman (illustrated in FIGS. 1-3) and a chair (illustrated in FIGS. 4-5).

The convertible bean bag furniture 10 generally includes an outer enclosure 20 and fill material 22. The outer enclosure defines an enclosed region in which the fill material is placed. In certain embodiments, the outer enclosure 20 may include a top panel 30, a bottom panel 32 and a side panel 34.

The top panel 30 and the bottom panel 32 may be formed in a variety of shapes depending on the intended use of the convertible bean bag furniture 10. In certain embodiments, the top panel 30 and the bottom panel 32 both have a generally oval or round configuration.

The side panel 34 may be formed in a variety of shapes depending on the intended use of the convertible bean bag furniture 10. In certain embodiments, the side panel 34 has a generally cylindrical configuration.

An upper edge 40 of the side panel 34 is attached to an edge of the top panel 30 and a lower edge 42 of the side panel 34 is attached to an edge of the bottom panel 32. The top panel 30, the bottom panel 32 and the side panel 34 thereby define the outer enclosure 20. A variety of techniques may be used to attach the side panel 34 to the top panel 30 and the bottom panel 32. An example of one suitable technique is sewing.

While it is possible to permanently seal the foam beads in the outer enclosure 20 during the manufacturing process, in certain embodiments, a first closure mechanism 48 such as a zipper may be attached to at least one of the top panel 30, the bottom panel 32 and the side panel 34 to seal the outer enclosure 20.

This first closure mechanism 48 enables the interior of the outer enclosure 20 to be accessed such as to place foam beads therein. An access control device (not shown) as may be required by consumer protection laws or regulations may be used in conjunction with the first closure mechanism 48 to reduce the potential of consumers accessing the fill material.

In certain embodiments, the access control device may include a second zipper. In other embodiments, the access control device includes a locking handle that is positioned inwardly such that the fill material 22 in the outer enclosure 20 causes the handle to remain in the locked configuration.

The outer enclosure 20 may be fabricated from a variety of materials using the concepts of the invention. Examples of these materials include leather, vinyl and fabric. Depending on the intended use of the convertible bean bag furniture 10, it is possible for the outer enclosure 20 to be water impermeable.

The outer enclosure 20 also includes a second closure mechanism 50 that extends around a portion of the outer enclosure 20. In certain embodiments, the second closure mechanism 50 is positioned proximate an intersection of the top panel 30 and the side panel 34.

The distance that the second closure mechanism 50 extends around the outer enclosure 20 may be selected based upon the intended object to which the convertible bean bag furniture 10 is intended to be converted. In certain embodiments, the second closure mechanism 50 extends about ½ of a distance around the outer enclosure 20 when the convertible bean bag furniture converts into a chair.

In certain embodiments, the second closure mechanism 50 is a zipper. In other embodiments, the second closure mechanism 50 is a hook and loop fastener such as is available under the designation VELCRO. In still other embodiments, the second closure mechanism 50 may be a plurality of buttons, snaps or any combination thereof.

A conversion panel 52 is attached to the top panel 30 and the side panel 34 proximate the second closure mechanism 50. The conversion panel 52 thereby seals the outer enclosure 20 when the second closure mechanism 50 is detached.

The shape of the conversion panel 52 is selected based upon the desired shape to which the convertible bean bag furniture 10 is to be converted. In certain embodiments, the conversion panel 52 may have an elongated shape with a width that is greater proximate a center thereof than proximate opposite ends thereof.

The conversion panel 52 may be fabricated from a material that is similar to the material from which the other portions of the outer enclosure 20 is fabricated. In certain embodiments, the conversion panel 52 may be fabricated with a different color than the other portions of the outer enclosure 20. The colors may be sufficiently different such that a person could readily determine the differences in color. This configuration thereby enhances the ability for the user to determine which configuration the convertible bean bag furniture is in.

The fill material 22 may have a variety of configurations. One criteria when selecting the fill material 22 is that the fill material 22 be readily reconfigurable such as when the convertible bean bag furniture 10 is moved between the ottoman configuration and the chair configuration. An example of one suitable material that can be used for the fill material is expanded foam beads.

In operation, the convertible bean bag furniture 10 is initially in the ottoman configuration (FIGS. 1-3) where the second closure mechanism 50 is in the sealed configuration. In this configuration, the fill material 22 may sufficiently fill the outer enclosure 20 such that the top panel 30 is at a distance from the bottom panel 32 that is similar to the height of the side panel 34. The top panel 30 can thereby be used as a support for a person or an object.

The second closure mechanism 50 is detached and the fill material 22 is permitted to move into the region defined by the conversion panel 52 and the top panel 30. Such a configuration may be similar to a conventional chair in that it has a seat portion and a back portion that is oriented at an angle with respect to the seat portion. The angle between the seat portion and the back portion may be affected by a variety of factors such as the width of the conversion panel 52 proximate the center thereof.

A person of skill in the art will appreciate that the second closure mechanism 50 may be positioned on other portions of the convertible bean bag furniture 10 to facilitate converting into alternative configurations. For example, the convertible bean bag furniture 10 may convert from the ottoman configuration to a C-shaped or L-shaped configuration so that the convertible bean bag furniture 10 may be used to support a person in a partially reclined orientation such as when watching television.

In yet another configuration, the convertible bean bag furniture 10 includes at least two of the second closure mechanisms 50, which enable the convertible bean bag furniture 10 to be converted between more than two configurations. For example, the two second closure mechanisms 50 may be placed at opposite ends of the convertible bean bag furniture 10. When both of the second closure mechanisms 50 are in the open configuration, the convertible bean bag furniture 10 may be moved to a C-shaped configuration.

The convertible bean bag furniture 10 may also include at least one receptacle 60 placed on a surface thereof. In certain embodiments, the receptacle 60 is attached to the side panel 34.

The receptacle 60 may have an opening along at least one edge thereof such that the receptacle 60 can be used to store objects of a person using the convertible bean bag furniture 10. The opening may be directed towards the top panel 30. Examples of such objects include remote controls, portable music players and cellular telephones.

The receptacle 60 may also include a closure mechanism to retain the objects in the receptacle 60. Examples of suitable closure mechanisms include a plurality of snaps or buttons and hook and loop fasteners.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. Convertible bean bag furniture comprising:

an outer enclosure that defines an enclosed region, wherein the outer enclosure comprises:

a side panel;

a bottom panel attached to a lower end of the side panel;

a top panel attached to an upper end of the side panel;

a conversion panel attached to an upper edge of the side panel and the top panel, wherein the conversion panel is fabricated from a different color than the side panel, the bottom panel and the top panel; and at least one closure mechanism attached to the side panel and the top panel proximate the conversion panel, wherein the at least one closure mechanism is positionable in an open configuration and a closed configuration, when the at least one closure mechanism is in the closed configuration, the enclosed region has a first volume, when the at least one closure mechanism is in the open configuration, the enclosed region has a second volume that is larger than the first volume; and a fill material placed in the enclosed region.

2. The convertible bean bag furniture of claim 1, wherein when the at least one closure mechanism is in the closed configuration, the convertible bean bag furniture is in a shape of an ottoman and wherein when the at least one closure mechanism is in the open configuration, the convertible bean bag furniture is positionable in a shape of a chair having a seat portion and a back portion that is oriented at an angle with respect to the seat portion.

3. The convertible bean bag furniture of claim 1, wherein the at least one closure mechanism comprises at least one of a zipper, a plurality of snaps and a hook and loop fastener.

4. The convertible bean bag furniture of claim 1, wherein the side panel has a cylindrical shape and wherein the bottom panel and the top panel have an oval shape and wherein the fill material comprises a plurality of expanded foam beads.

5. The convertible bean bag furniture of claim 1, wherein the at least one closure mechanism comprises a first closure mechanism and a second closure mechanism.

6. The convertible bean bag furniture of claim 1, and further comprising an at least partially enclosed receptacle attached to an outer surface of the enclosure.

7. A method using convertible bean bag furniture comprising:

forming an outer enclosure comprising a side panel, a bottom panel, a top panel, a conversion panel and at least one closure mechanism, wherein the bottom panel is attached to a lower end of the side panel, wherein the top panel is attached to an upper end of the side panel, wherein the conversion panel is attached to an upper edge of the side panel and the top panel, wherein the conversion panel is fabricated from a different color than the side panel, the bottom panel and the top panel, wherein the at least one closure mechanism is attached to the side panel and the top panel proximate the conversion panel and wherein the outer enclosure defines an enclosed region;

placing fill material in the enclosed region;

positioning the at least one closure mechanism in a closed configuration, when the at least one closure mechanism is in the closed configuration, the outer enclosure has a first volume; and placing the at least one closure mechanism in an open configuration, when the at least one closure mechanism is in the open configuration, the outer enclosure has a second volume that is larger than the first volume.

8. The method of claim 7, wherein when the at least one closure mechanism is in the closed configuration, the convertible bean bag furniture is in a shape of an ottoman and wherein when the at least one closure mechanism is in the open configuration, the convertible bean bag furniture is positionable in a shape of a chair having a seat portion and a back portion that is oriented at an angle with respect to the seat portion.

9. The method of claim 7, wherein the at least one closure mechanism comprises at least one of a zipper, a plurality of snaps and a hook and loop fastener.

10. The method of claim 7, wherein the outer enclosure comprises a side panel, a bottom panel, a top panel and a conversion panel, wherein the bottom panel is attached to a lower end of the side panel, wherein the top panel is attached to an upper edge of the side panel and wherein the conversion panel attaches the top panel to the side panel proximate the at least one closure mechanism.

11. The method of claim 7, wherein the side panel has a cylindrical shape and wherein the bottom panel and the top panel have an oval shape.

12. The method of claim 7, wherein the fill material comprises a plurality of expanded foam beads and wherein the outer enclosure further comprises at least partially enclosed receptacle attached to an outer surface of the enclosure.

* * * * *